US007448559B2

(12) United States Patent
Le Maner et al.

(10) Patent No.: US 7,448,559 B2
(45) Date of Patent: Nov. 11, 2008

(54) FLUID PRODUCT SPRAY HEAD AND DISTRIBUTING PUMP COMPRISING THIS SPRAY HEAD

(75) Inventors: François Le Maner, La Vallée Montaure (FR); Wilfrid Beaujour, Darnetal (FR)

(73) Assignee: Valois S.A.S., Le Neubourg (FR)

( * ) Notice: Subject to any disclaimer, the term of this patent is extended or adjusted under 35 U.S.C. 154(b) by 0 days.

(21) Appl. No.: 10/578,225

(22) PCT Filed: Nov. 5, 2004

(86) PCT No.: PCT/FR2004/050569

§ 371 (c)(1),
(2), (4) Date: Sep. 15, 2006

(87) PCT Pub. No.: WO2005/045292

PCT Pub. Date: May 19, 2005

(65) Prior Publication Data

US 2007/0131799 A1 Jun. 14, 2007

(30) Foreign Application Priority Data

Nov. 7, 2003 (FR) ..... 03 13095

(51) Int. Cl.
*B05B 1/34* (2006.01)

(52) U.S. Cl. ..... 239/463; 239/115; 239/118; 239/437; 239/490; 239/533.1; 239/333; 239/483; 239/489; 239/602; 239/DIG. 12; 222/149; 222/402.1; 222/494

(58) Field of Classification Search ..... 239/114, 239/115, 117, 118, 437, 451, 452, 456, 463, 239/464, 490, 492, 533.1, 533.13, 602, DIG. 12, 239/482, 483, 489, 333, 583; 222/107, 149, 222/402.1, 494, 496
See application file for complete search history.

(56) References Cited

U.S. PATENT DOCUMENTS

| | | | | | |
|---|---|---|---|---|---|
| 3,437,270 | A | * | 4/1969 | Venus, Jr. | 239/118 |
| 3,545,682 | A | * | 12/1970 | Beard | 239/492 |
| 3,990,640 | A | | 11/1976 | Laauwe | |
| 5,273,191 | A | * | 12/1993 | Meshberg | 222/402.1 |
| 2002/0088873 | A1 | | 7/2002 | Blake | |

FOREIGN PATENT DOCUMENTS

| | | | |
|---|---|---|---|
| FR | 2792552 | A1 | 10/2000 |
| FR | 2815611 | A1 | 4/2002 |
| FR | 2832079 | A1 | 5/2003 |

* cited by examiner

*Primary Examiner*—Steven J Ganey
(74) *Attorney, Agent, or Firm*—Sughrue Mion, PLLC

(57) ABSTRACT

A fluid product spray head (40) comprises a spray orifice (45) and a spray profile (100) upstream from this spray orifice (45). Said spray profile has a swirling chamber (101) connected, during the spraying of the product, to the spray orifice (45) and to at least one non-radial channel (110) connected to the swirling chamber (101). The spray profile (100) is provided in the bottom of the spray head (40). A obturator (38) interacts with the spray orifice (45) while being able to be displaced and/or deformed between a closing position of the spray orifice (45) and an open position of the spray orifice (45). The inventive spray head (40) has an axially hollow sleeve (150) that accommodates the spray profile (100), and said obturator (38) axially displaces and/or deforms at least partially in said sleeve (150).

11 Claims, 5 Drawing Sheets

FLUID PRODUCT SPRAY HEAD AND DISTRIBUTING PUMP COMPRISING THIS SPRAY HEAD

The present invention relates to a fluid product spray head, a dispensing pump comprising this spray head and a fluid product dispenser comprising such a pump.

Fluid product dispensing pumps are well known in the prior art, particularly for dispensing products in the areas of cosmetics, perfumery and pharmacy. They generally comprise a pump body in which a piston slides to dispense a dose of fluid product each time it is actuated. In particular with pharmaceutical products, pumps sometimes comprise obturator provided in the dispensing orifice. These obturator are particularly intended to avoid any contamination of the fluid product between two actuations of the pump, and are therefore driven at rest to their closed position. The presence of this obturator causes constraints with regard to spraying the product. Indeed, when the pump is intended to deliver a spray, a spray profile is generally placed upstream from the spray orifice, this spray profile generally comprising a swirling chamber connected to the spray orifice while the product is being dispensed, and at least one non-radial channel which is connected to said swirling chamber. The presence of an obturator complicates the embodiment of the spray profile and above all renders the performance or characteristics of the spray unstable depending on the position of said obturator.

The purpose of the present invention is to provide a fluid product spray head which does not reproduce the above-mentioned drawbacks.

Another purpose of the present invention is to provide a fluid product dispensing head and pump which guarantee that the product is dispensed in the form of a fine spray each time the pump is actuated.

Yet another purpose of the present invention is to provide a fluid product dispensing head and pump which are simple and inexpensive to manufacture and assemble and safe and reliable to use.

The subject matter of the present invention is therefore a fluid product spray head comprising a spray orifice and a spray profile upstream from said spray orifice, said spray profile comprising a swirling chamber connected when the product is being sprayed to said spray orifice and at least one non-radial channel connected to said swirling chamber, said spray profile being embodied in the bottom of said spray head, an obturator interacting with said spray orifice by being movable and/or deformable between a closed position of said spray orifice and an open position of said spray orifice, said head comprising a hollow axial sleeve accommodating said spray profile, said obturator being displaced and/or deformed axially at least partially in said sleeve, said at least one non-radial channel of the spray profile extending at least partially into the lateral axial wall of said sleeve.

To advantage, said at least one non-radial channel extends over approximately the entire axial height of said axial sleeve.

To advantage, said at least one not radial sleeve extends obliquely into said lateral wall of the sleeve.

According to a first embodiment variant of the invention, the swirling chamber is of nil volume in the closed position of the obturator, the displacement and/or deformation of said obturator towards its open position forming said swirling chamber upstream from said spray orifice and downstream from said at least one non-radial channel.

According to a second embodiment variant, the swirling chamber is of non-nil volume in the closed position of said obturator, the latter traversing said swirling chamber to block said spray orifice.

To advantage, the spray profile comprises two non-radial channels placed symmetrically relative to the central axis of the pump.

To advantage, said axial sleeve is formed in one piece in the bottom of said spray head.

The subject matter of the present invention further comprises a fluid product dispensing pump comprising a spray head as described above.

To advantage, said pump comprises a pump chamber defining the dose of the product expelled each time it is actuated, placed immediately upstream from said spray orifice, said obturator sliding in said pump chamber.

The subject matter of the present invention further comprises a device for dispensing fluid product that comprises a tank and a pump as described above.

Other characteristics and advantages of the present invention will emerge more clearly from the following detailed description of two embodiments thereof, drawn up with reference to the appended drawings, given as non-restrictive examples, and wherein.

Figure 7:
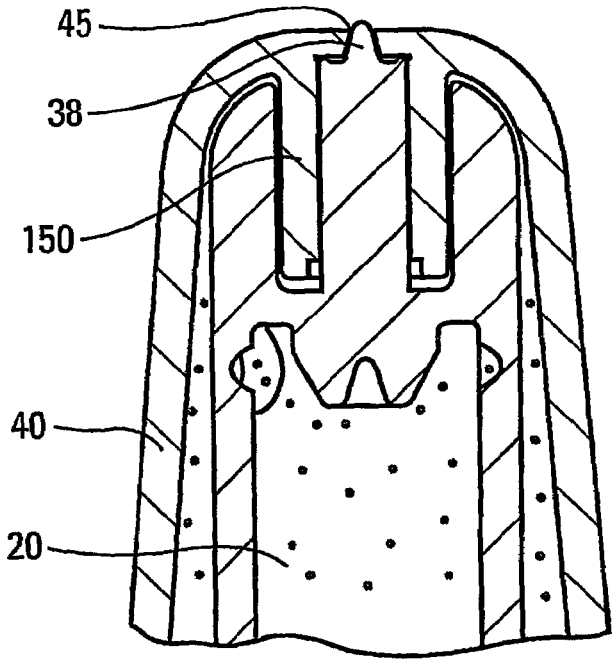
FIGS. 7 and 8 are views similar to those in FIGS. 5 and 6 respectively, showing an embodiment variant of the invention.
Figure 8:
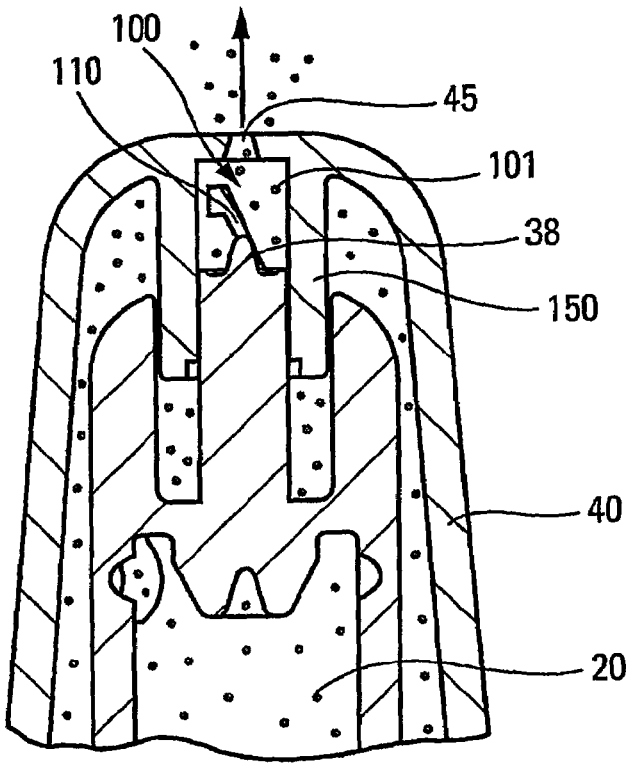
Figure 10A:
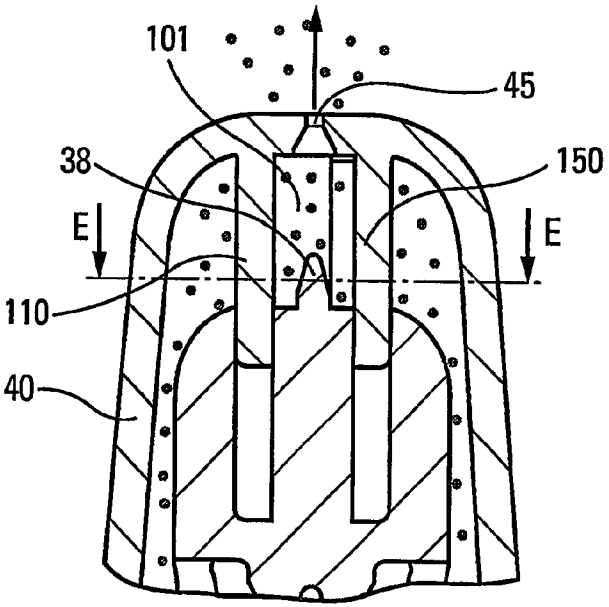
Figure 10B:
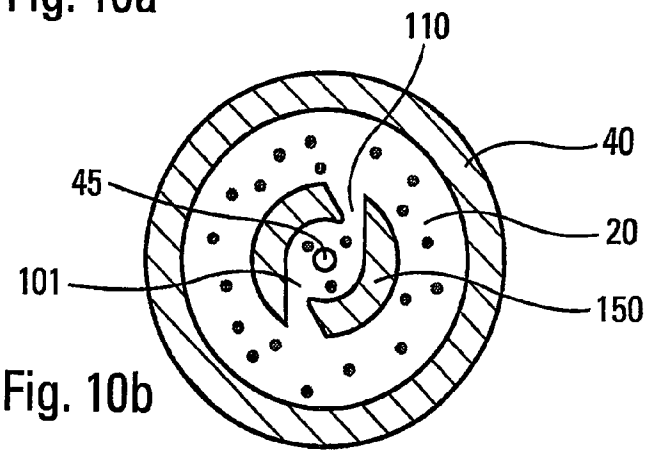
Figure 9A:
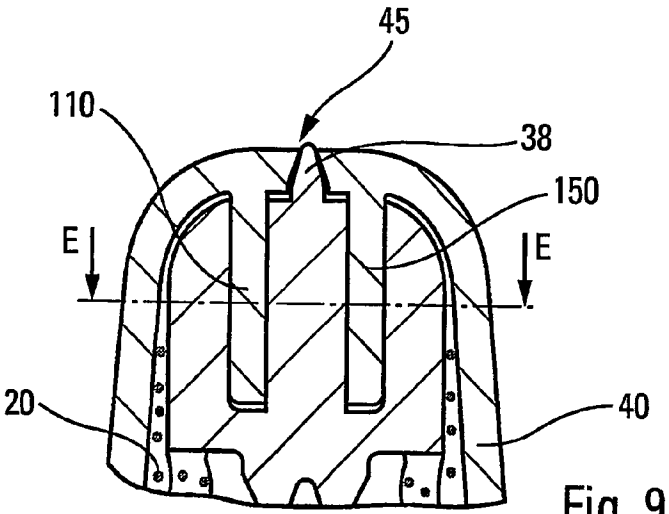
Figure 9B:
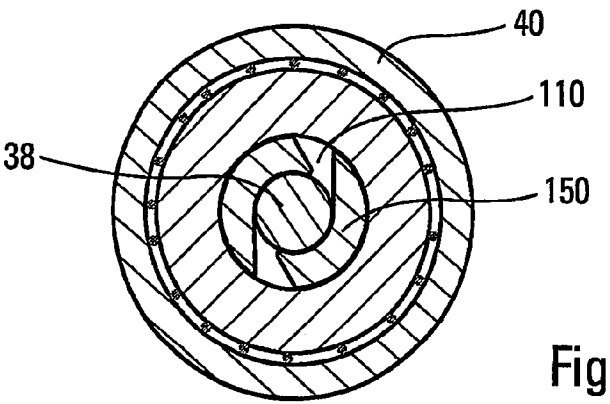

FIGS. 9*a* and 10*a* are views similar to those in FIGS. 7 and 8 respectively, showing another embodiment variant of the invention; and FIGS. 9*b* and 10*b* are cross-section views along the lines E-E of FIGS. 9*a* and 10*a* respectively.

The invention will be described with reference to a particular pump, but it is understood that it applies to all types of pumps or valves.

Figure 1:
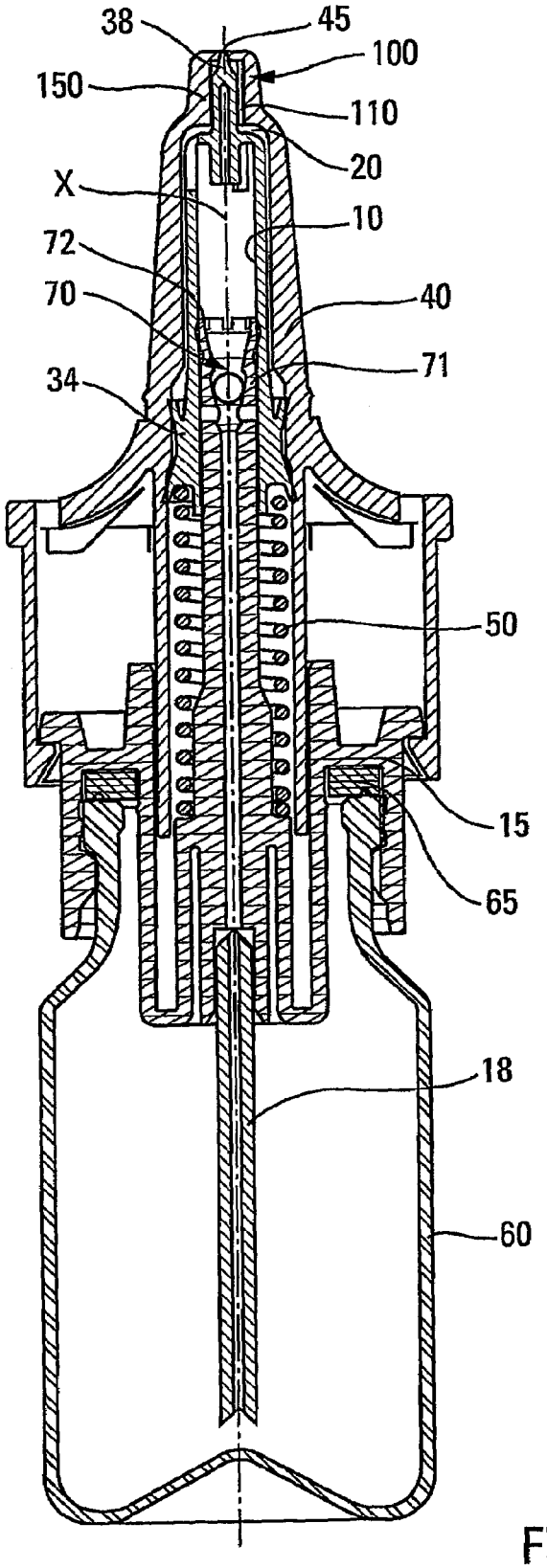
FIG. 1 is a diagrammatic view in transverse cross-section of a device for dispensing fluid products comprising a pump for dispensing fluid products according to an advantageous embodiment of the present invention, in the rest position of the pump.

With reference to FIG. 1, the device for dispensing fluid products comprises a tank 60 and a pump mounted on said tank by means of a retaining or fixing ring 15, with interposition of a gasket 65. These elements may be of any shape and FIG. 1 shows only one particular embodiment example. The pump comprises a pump body 10 defining a pump or dosing chamber 20 containing the product to be dispensed each time the pump is actuated, and in which a first piston 72 slides. A dispensing head 40 is mounted on the retaining ring 15, and the pump chamber 20 is to advantage formed in said head. The pump chamber additionally comprises an inlet valve 70, and an obturator 38 is provided upstream from the dispensing orifice 45 and directly interacting with it between a closed position and a dispensing position. The pump body 10 is to advantage embodied in one piece with said obturator 38, being formed inside it, and the first piston 72 may to advantage be embodied in one piece with the retaining ring 15 and the seat 71 of the inlet valve 70. A spring 50, preferably only one and preferably away from all contact with the fluid product, is placed in the pump to bring the first piston 72 back to its rest position and the obturator 38 to its closed position after each actuation of the pump. Furthermore, a plunger or dip tube 18 is connected to said pump to extend to the bottom of the tank in order to dispense the totality of the product contained therein. A spray profile 100 is provided in the dispensing orifice 45 in order to spray the product expelled each time the pump is actuated.

Figure 2:
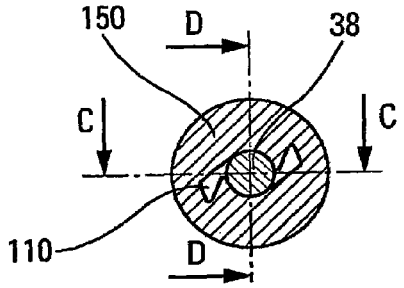
FIG. 2 is a diagrammatic view in horizontal cross-section through the spray head shown in FIG. 1.
Figure 3:
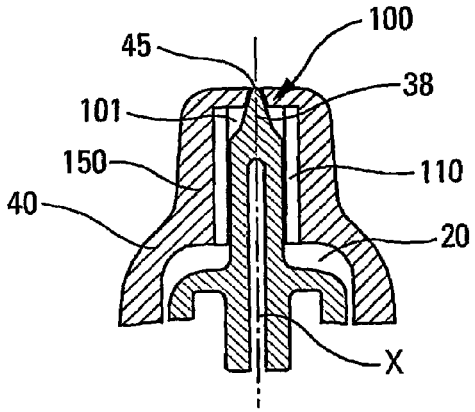
FIGS. 3 and 4 are diagrammatic views in transverse cross-section of a part of the spray head shown in FIG. 1, taken along the cross-section lines C-C and D-D respectively in FIG. 2.
Figure 4:
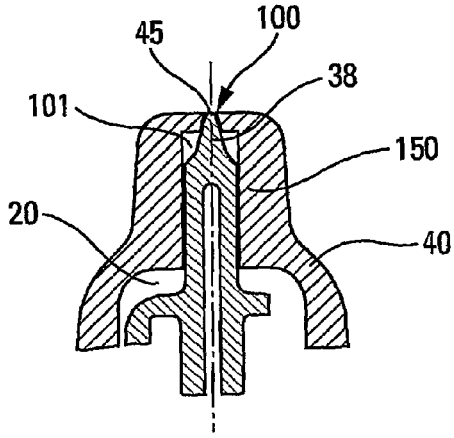

FIGS. 2 to 4 show a first embodiment variant of the invention. According to this first embodiment variant, the end of the spray head 40 which accommodates the spray orifice 45, is contracted and forms a sleeve 150 in which the obturator 38 slides axially. This obturator 38 may to advantage be embodied in one piece with a second piston 34 as can be seen in FIG. 1. The sleeve 150 is embodied preferably in one piece in the bottom of the spray head 40 and it accommodates the spray profile 100. This spray profile 100 comprises a swirling chamber 101, which is placed directly upstream from the spray orifice 45 and which is connected to it in the dispensing position. The spray profile 100 also comprises at least one non-radial channel 110, preferably two placed symmetrically one relative to the other around the central axis X of the pump. Clearly, any number of channels 110 are conceivable. These non-radial channels 110 are connected to the swirling chamber 101 when the product is expelled. As can be seen in FIGS. 2 to 4, the non-radial channels are to advantage embodied at least partially in the lateral wall of the sleeve 150, preferably over its entire height. This allows said spray profile to be embodied in a very straightforward or simple way without elements needing to be added to said head. In this embodiment variant, the swirling chamber 101 is of non-nil volume in the closed position shown in FIGS. 3 and 4, and said obturator 38 moves in fact axially inside said swirling chamber 101. The non-radial channels 110 form a part of the pump chamber 20 and the obturator 38, which forms the outlet valve of the pump chamber 20, allows, when it opens, the product contained in this pump chamber 20 to be dispensed in the form of a spray through the spray orifice 45.

Figure 5:
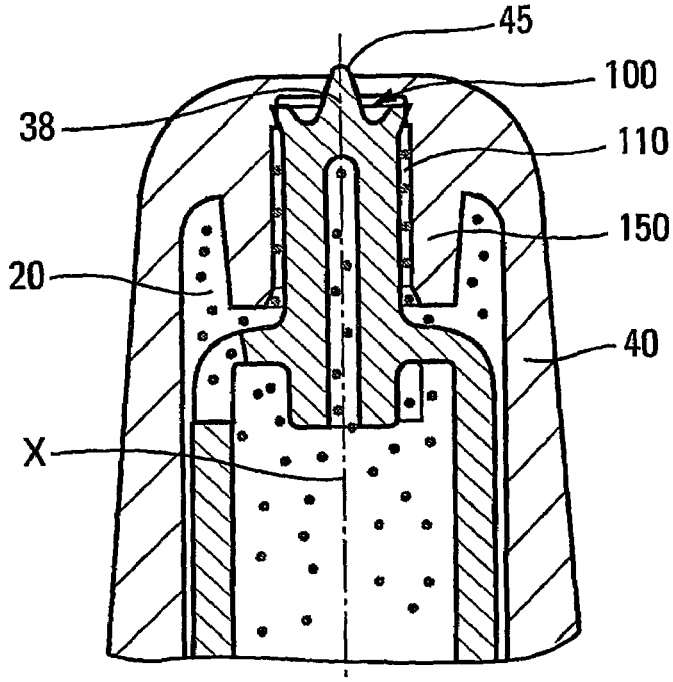
FIG. 5 is a diagrammatic view similar to that in FIG. 3, showing an embodiment variant of the present invention.
Figure 6:
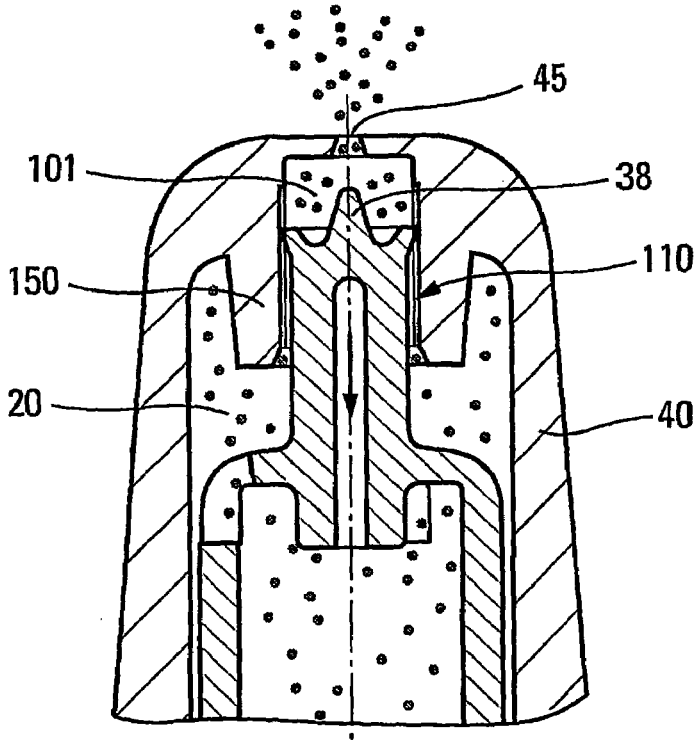
FIG. 6 is a view similar to that in FIG. 5, in the spray position.

FIGS. 5 and 6 show an embodiment variant, in which the axial sleeve 150 is also embodied in one piece in the bottom of the head 40, but projecting relative to said bottom. Likewise, the obturator 38 is embodied slightly differently, in particular comprising the obturating element itself which is central and which interacts directly with the spray orifice 45 but also a peripheral lip surrounding said obturating element and sliding in said axial sleeve 150. The non-radial channels 110 also extend over approximately the entire height of the axial sleeve, with the exception of the upper end part closed by said obturator 38 in the closed position. In this embodiment, the swirling chamber 101 is of approximately nil volume in the closed position and it is during displacement of the obturator 38 towards its open position that the swirling chamber is created, by being connected to the non-radial channels 110 that allow the product to be sprayed.

FIGS. 7 and 8 show another embodiment variant, in which the obturator 38 is fitted onto the sleeve 150 so as to reduce the ullage or dead volume in the closed position. Moreover said at least one non-radial channel 110 may be oblique in the lateral wall of the sleeve 150 so as to bring the product into the swirling chamber 101.

FIGS. 9*a* and 10*b* show yet another embodiment variant in which the sleeve 150 is split over practically its entire height, each split forming a non-radial channel 110. The views in horizontal cross-section in FIGS. 9*b* and 10*b* show how the obturator fills the ullage in the closed position and conversely opens the spray orifice 45 and the non-radial channels 110 in the spray position.

The implementation of the invention, which to advantage provides for spray channels to be embodied over approximately the whole height of an axial sleeve provided in the bottom of the head, is advantageous in that it simplifies the manufacture of this spray profile in an end part of the spray head 40 which is traditionally relatively fragile by reason of the thinness of the walls existing at these places. The present invention in particular makes it possible to avoid having to provide channels in the bottom wall of said axial sleeve 150 which includes the spray orifice 45. On the contrary, the totality of this bottom surface of the axial sleeve 150 forms the swirling chamber 101 when the obturator is in the open position, as shown in FIG. 6.

Although the invention has been described with reference to two embodiment variants thereof, it is understood that is not restricted to the examples shown, but that a man skilled in the art is able to make any effective modifications without departing from the context of the present invention as defined by the appended claims.

The invention claimed is:

1. Fluid product spray head (40) comprising a spray orifice (45) and a spray profile (100) upstream from said spray orifice (45), said spray profile comprising a swirling chamber (101) connected, when the product is sprayed, to said spray orifice (45) and at least one non-radial channel (110) connected to said swirling chamber (101), said spray profile (100) being embodied in the bottom of said spray head (40), an obturator (38) directly interacting with said spray orifice (45) by being movable or deformable between a closed position of said spray orifice (45) and an open position of said spray orifice (45), wherein said head (40) further comprises a hollow axial sleeve (150) accommodating said spray profile (100), said obturator (38) being displaced or deformed axially at least partially in said sleeve (150), said at least one non-radial channel (110) of the spray profile (100) extending at least partially in the lateral wall of said sleeve (150); wherein said at least one non-radial channel extends obliquely in said lateral wall of the sleeve; and wherein said at least one non-radial channel is void of structure for all positions of said obturator between the closed position of said spray orifice and the open position of said spray orifice.

2. Head according to claim 1, wherein said at least one non-radial channel (110) extends over approximately the entire axial height of said axial sleeve (150).

3. Head according to claim 1, wherein the swirling chamber (101) is of nil volume in the closed position of the obturator (38), the displacement and/or deformation of said obturator (38) towards its open position forming said swirling chamber (101) upstream from said spray orifice (45) and downstream from said at least one non-radial channel (110).

4. Head according to claim 1, wherein the swirling chamber (101) is of non-nil volume in the closed position of said obturator (38), the latter traversing said swirling chamber (101) to block said spray orifice (45).

5. Head according to claim 1, wherein the spray profile (100) comprises two non-radial channels (110) placed symmetrically relative to the central axis (X) of the pump.

6. Head according to claim 1, wherein said axial sleeve (150) is formed in one piece in the bottom of said spray head (40).

7. Fluid product dispensing pump, characterised in that it comprises a spray head (40) according to claim 1.

8. Pump according to claim 7, wherein said pump comprises a pump chamber (20) defining the dose of product expelled each time it is actuated, placed immediately upstream of said spray orifice (45), said obturator (38) sliding in said pump chamber (20).

9. Fluid product dispensing device, characterised in that it comprises a tank (60) and a pump according to claim 7.

10. The head according to claim 1, wherein the obturator directly interacts with the spray orifice by being movable between a closed position of said spray orifice and an open position of said spray orifice.

11. The head according to claim 1, wherein the obturator directly interacts with the spray orifice by being deformable between a closed position of said spray orifice and an open position of said spray orifice.

* * * * *